United States Patent [19]

Pangburn

[11] 4,172,461

[45] Oct. 30, 1979

[54] NAIL FORM

[76] Inventor: William E. Pangburn, 201 N. Kenwood #10, Glendale, Calif. 91206

[21] Appl. No.: 851,061

[22] Filed: Nov. 14, 1977

[51] Int. Cl.[2] ..... A45D 29/00

[52] U.S. Cl. ..... 132/73

[58] Field of Search ..... 132/73, 79; 424/52

[56] References Cited

U.S. PATENT DOCUMENTS

| | | | |
|---|---|---|---|
| 1,653,871 | 12/1927 | Rüttger-Pelli | 132/73 X |
| 2,031,225 | 2/1936 | O'Donnell | 132/73 X |

FOREIGN PATENT DOCUMENTS

| | | | |
|---|---|---|---|
| 178165 | 4/1954 | Austria | 132/73 |
| 902193 | 1/1954 | Fed. Rep. of Germany | 132/73 |

*Primary Examiner*—G. E. McNeill

*Attorney, Agent, or Firm*—William W. Haefliger

[57] ABSTRACT

A device usable to aid attachment of an artificial fingernail to a natural fingernail comprises:

(a) a form having a upwardly convex surface and defining an arcuate rearward edge shaped for reception under the forward edge portion of the natural nail, and (b) a holder having two laterally spaced tines respectively supporting lower portions of the form, said tines being bendable into selected set configuration, (c) the holder including generally tab shaped finger grips integral with said tines and adapted to resiliently grip opposite portions of a finger or thumb carrying said natural nail to support the form in a position wherein said form rearward edge is retained under said forward edge portion of the natural nail and adjacent thereto.

1 Claim, 7 Drawing Figures

NAIL FORM

BACKGROUND OF THE INVENTION

This invention relates generally to apparatus facilitating application of artificial fingernails to natural nails, and more specifically concerns a re-usable device of superior construction allowing safe, fast application of liquid plastic (as for example acrylic) synthetic nails to natural nails.

In the past, synthetic plastic nails have been formed or deposited on forms such as foils which project beneath the nail tip and project forwardly therefrom. Such foils or shields suffer from a number of disadvantages among which are lack of reusability, difficulty in holding them in position while the applied nail composition cures or hardens, and lack of ready adaptability to different finger and natural nail sizes. To my knowledge, no-one has previously provided a device which overcomes all of such disadvantages, and which embodies the unusual combinations and sub-combination of advantages in construction, mode of operation and results as are now afforded by the present invention.

SUMMARY OF THE INVENTION

The present invention aids attachment or build-up of a synthetic fingernail to or on a natural fingernail, and basically comprises:

(a) a form having an upwardly convex surface and defining an arcuate rearward edge shaped for reception under the forward edge portion of the natural nail, and (b) a holder having two laterally spaced tines respectively supporting lower portions of the form, said tines being bendable into selected set configuration, (c) the holder including generally tab shaped finger grips integral with said tines and adapted to resiliently grip opposite portions of a finger or thumb carrying said natural nail to support the form in a position wherein said form rearward edge is retained under said forward edge portion of the natural nail and adjacent thereto.

As will be seen, the form may consist of a plastic sheet such as TEFLON provided with a textured upper convex surface to inhibit run-off of the applied liquid plastic and to impart a roughening to the underside of the nail to thereby prevent "shininess"; the finger grips may have yoke shape and be defined by rearward extensions of the tines so as to engage opposite portions of a finger rearward of the natural nail; the tines typically are bendable and retain their shape so as to lightly grip the finger; the tines may consist of wires covered by plastic sheaths; and the form may be attached as by staples to outer and mid-portions of the tines, between a forward bend and the rearward finger grips to allow shaping of the device to fit different size fingers and thumbs, as will appear; and the provision of a re-usable, simply constructed and efficient device which allows application of an acrylic nail to a natural nail, in a safe manner.

These and other objects and advantages of the invention, as well as the details of an illustrative embodiment, will be more fully understood from the following description and drawings, in which:

DETAILED DESCRIPTION

DETAILED DESCRIPTION

In FIGS. 1-4 the illustrated device includes a form 10 used in aiding attachment of a synthetic plastic (as for example acrylic) fingernail 11 to a natural fingernail. The latter is shown at 12 in FIG. 2 on a finger 13, and the synthetic plastic paste or liquid 11*a* may be brushed on the natural nail and on the form so that the final product appears as in FIG. 5, at 11. A brush 14 is illustrative of applicators, in general.

Figure 1:
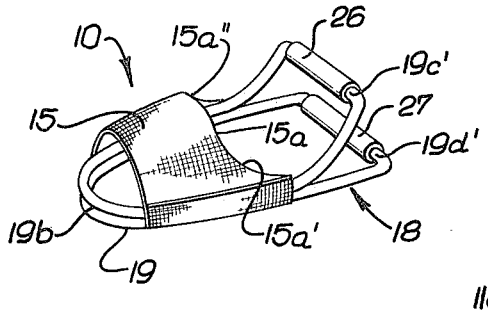
FIG. 1 is a perspective view of a form embodying the invention.
Figure 4:
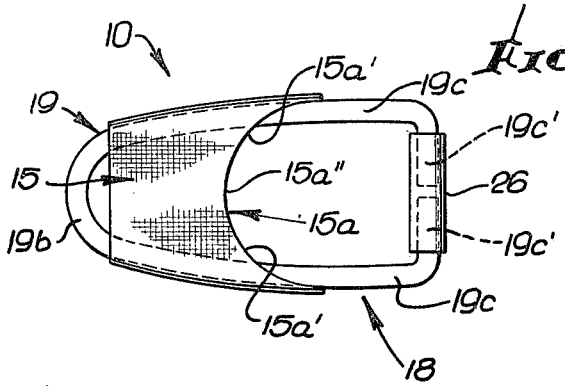
FIG. 4 is a top plan view of the FIG. 1 nail form.
Figure 5:
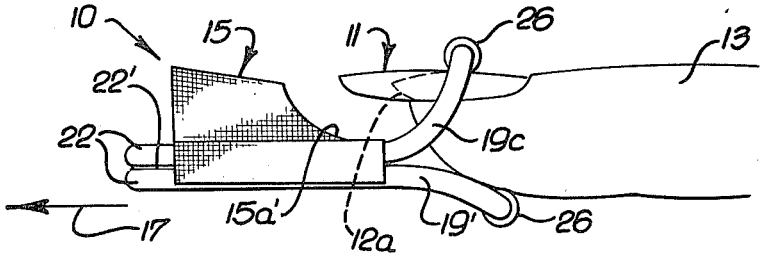
FIG. 5 is a side elevation showing removal of the form from a finger after completion of nail application.

The form 10 has an upwardly convex upper surface 15 defining an arcuate rearward edge 15*a* shaped for reception directly under the forward edge portion, or lip 12*a* of the natural nail 12. The edge 15*a* is typically curved downwardly, sidewardly and rearwardly at 15*a'* at opposite sides of an apex 15*a''*, as best seen in FIGS. 1 and 4, whereby it fits the contour of the forward natural nail lip 12*a*. The form 10 or shield may be defined by flexible plastic sheet material, as for example a tetrafluoroethylene product such as TEFLON, and for best results has a thickness between 0.005 and 0.025 inch. TEFLON separates readily from the cured nail 11, as shown in FIG. 5, where the device is separated relatively forwardly (indicated by arrow 17) from the finger and nail 11. Further, the upper surface 15 preferably has a textured or roughened configuration, as for example a microweave (warp and woof) surface pattern, to define tiny shallow recesses. As a result, the underside of the cured liquid nail 11 will be molded to the same (but reverse) configuration, and the final result is that the nail 11 will not appear shiny, as is objectionable, but will have an appearance more like that of a natural nail due to light dispersion by the tiny recesses formed at the underside of the nail as a product of the molding process. Alternative plastic compositions include polyester and silicone; and the sheet may include layers of two or more of such plastics in sheet configuration.

Figure 2:
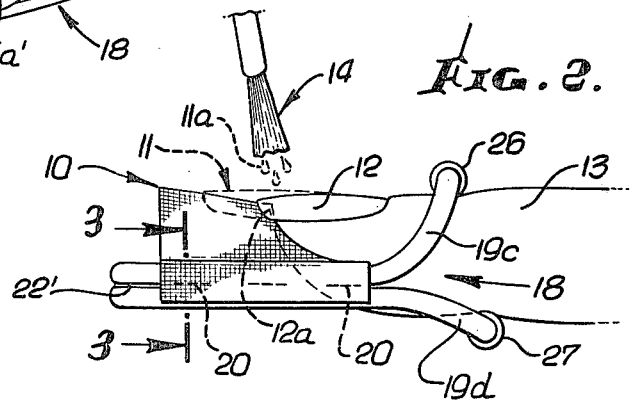
FIG. 2 is a side elevation showing the form in use.
Figure 3:
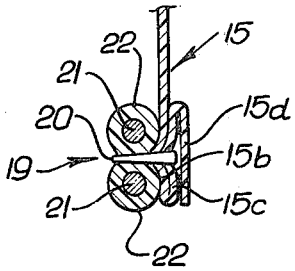
FIG. 3 is an enlarged cross section taken in elevation on lines 3—3 of FIG. 2.

The device also includes a holder 18 having two laterally spaced tines 19 which are alike, and which respectively support lower portions of the form 10 at the laterally outer sides of the longitudinally forwardly elongated holder. Reference to FIGS. 2 and 3 show that staples 20 may advantageously be employed to attach the lower portions 15*b* of the sheet to the tines. Terminal flaps 15*c* integral with the sheet are folded up and stapled through 15*c* and lower portions 15*b*. Terminal flaps 15*d* integral with flaps 15*c* are folded down and bonded to 15*c*, concealing outer surfaces of staples 20.

FIG. 3 also shows that the tines 19 may each consist of two parallel, bendable metallic wires 21 and two non-metallic tubular sheaths 22 in which the wires are respectively received. The sheaths may be joined at their lengthwise extending interfaces 22', adjacent the sheet lower portions **15*b*, and also at a forward location where the tines are integrally joined at a forward U-shaped bend 19*b*. In this regard, the tines 19 taper toward bend 19*b*, so as to laterally grip the flesh of the finger therebetween, and so as to shape the sheet or form 15 to laterally taper forwardly, so as to raise the crest of the shield to the general upper most or crest level of the natural fingernail. See FIG. 2** in this regard.

The bendable nature of the tines facilitates manual lateral spreading or closing together of same to best fit or grip a particular finger to which the device is applied. Thus, the bendable metal wire 21 may consist of steel or aluminum or other material and may have 24 gauge size. The wire sheath material may consist of polyvinyl chloride, i.e. PVC.

In accordance with a further feature of the invention, the holder typically incorporates generally yoke shaped finger grips integral with the tines, and adapted to resiliently grip opposite portions of a finger or thumb, to support the form 10 in position as seen in FIG. 2. As shown, the grips may take a spreadable tab configuration, and typically a yoke shape defined by rearwardly diverging, upper and lower extensions **19*c* and 19*d* of the two wires and sheaths which make up each tine. Also, the in-turned ends 19*c'* of the upper extensions 19*c* may be joined by an upper tubular plastic member 26; and similar in-turned ends 19*d'* of the lower extensions may be joined by a lower tubular member 27. Members 26 and 27 extend laterally in FIGS. 1–5 to grip upper and lower portions of the finger, which spreads the members apart when the finger is inserted therebetween as in FIG. 2. The extensions 19*c* and 19*d* resiliently urge the members 26 and 27** toward one another, to provide yieldable gripping force, which is effective but comfortable.

Figure 6:
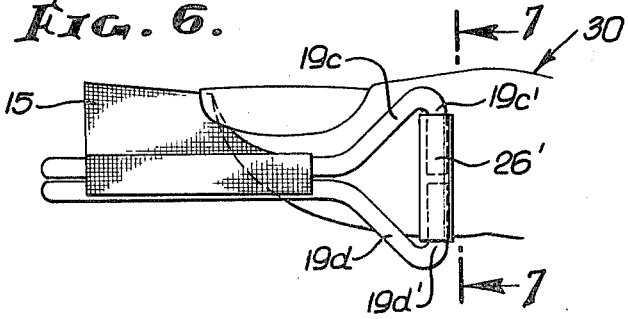
FIG. 6 is an elevation showing a different configuration of the finger or thumb grips.
Figure 7:
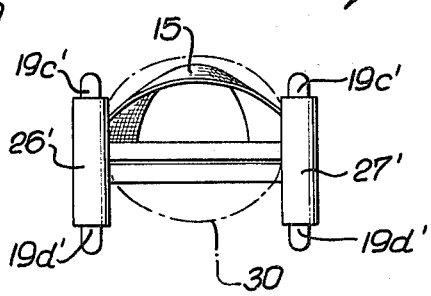
FIG. 7 is an end elevation on lines 7—7 of FIG. 6, showing the manner in which the sides of a thumb may be gripped.

In FIGS. 6 and 7, the members 26' and 27' extend vertically, and respectively interconnect the end portions **19*c'* and 19*d'*. As a result, a thumb 30 may be accommodated between the laterally spaced, upright tubular members 26' and 27'**.

Unusually advantageous features of the device include:

(1) ease of application to and release from a finger or thumb, with comfort;

(2) positive support of the form or shield 10, with comfort;

(3) light weight, simple construction, facilitating reusability;

(4) plastic construction facilitating sterilization, as in alcohol, after each use;

(5) one-size of the device fits all finger and thumb sizes, due to bendability of wires or narrowing the space between the tines;

(6) superior protection for the new acrylic nail while it hardened or cures;

(7) the textured surface of the form prevents nail shininess;

(8) the textured surface of the form helps keep soft acrylic material in place, and avoids run-off;

(9) the textured surface of the form promotes aeration and faster curing of the underside of the nail;

(10) fast release of the acrylic nail from the form, and prevention of sticking, to the underside of the form, as well as the top side.

I claim:

1. For use in aiding attachment of a synthetic fingernail to a natural fingernail, the combination, comprising (a) a form having an upwardly convex surface and defining a rearward edge which is rearwardly and downwardly arcuately shaped for reception under the forward edge portion of the natural nail, and (b) a holder having two laterally spaced tines respectively supporting lower portions of the form, said tines being bendable into selected set configuration, (c) the holder including two generally yoke shaped finger grips integral with said tines, and spaced rearwardly of said form, the grips being bendable to be spread apart so as to resiliently grip upper and lower portions of a finger or thumb carrying said natural nail to support the form in a position wherein said form rearward edge is retained under said forward edge portion of the natural nail and adjacent thereto, both said finger grips formed as rearward extensions of said tines, (d) each of said two tines including upper and lower parallel metallic wires and two non-metallic sheaths respectively receiving the wires, the grips including an upper grip integral with the two upper wires, and a lower grip integral with the two lower wires.

* * * * *